United States Patent [19]

Li et al.

[11] Patent Number: 5,069,428

[45] Date of Patent: Dec. 3, 1991

[54] METHOD AND APPARATUS OF CONTINUOUS DYNAMIC JOULE HEATING TO IMPROVE MAGNETIC PROPERTIES AND TO AVOID ANNEALING EMBRITTLEMENT OF FERRO-MAGNETIC AMORPHOUS ALLOYS

[75] Inventors: James C. M. Li, 39 Crestriew Dr., Pittsford, N.Y. 14534; Der-Ray Huang, Taoyuan Hsien, Taiwan

[73] Assignees: James C. M. Li, Pittsford, N.Y.; China Steel Corporation, Kaohsiung, Taiwan

[21] Appl. No.: 379,329

[22] Filed: Jul. 12, 1989

[51] Int. Cl.[5] ..... C21D 9/62

[52] U.S. Cl. ..... 266/104

[58] Field of Search ..... 266/104

[56] References Cited

U.S. PATENT DOCUMENTS 4,085,922 4/1978 Moreau ..... 266/104

4,154,432 5/1979 Janatka et al. ..... 266/104

4,943,036 7/1990 Sato et al. ..... 266/104

*Primary Examiner*—John P. Sheehan

*Attorney, Agent, or Firm*—Ladas & Parry

[57] ABSTRACT

A method and apparatus of dynamic heat treating the ferromagnetic amorphous alloys by applying AC current or pulsed high current on the alloys in the form of a ribbon are disclosed. The amorphous ribbon is continuously passed through a pair of electrodes from which AC current is conducted on the amorphous ribbon to perform a Joule heating. A DC magnetic field is applied on the amorphous ribbon preferably along a length direction thereof to improve the soft magnetic properties of the amorphous alloys. The DC magnetic field can be applied on either the section of the amorphous ribbon between the pair of electrodes or the section that has already been heat treated. With the method and apparatus, ferromagnetic amorphous alloys with improved magnetic properties such as greater magnetic induction, lower coercivity and low hysteresis loss are resulted and the annealing embrittlement is avoided.

7 Claims, 10 Drawing Sheets

METHOD AND APPARATUS OF CONTINUOUS DYNAMIC JOULE HEATING TO IMPROVE MAGNETIC PROPERTIES AND TO AVOID ANNEALING EMBRITTLEMENT OF FERRO-MAGNETIC AMORPHOUS ALLOYS

BACKGROUND OF THE INVENTION

1. Field of the Invention

The present invention relates to a method and apparatus of treating ferromagnetic amorphous alloys to improve the magnetic properties and to avoid annealing embrittlement thereof, and more particularly to a method and apparatus of continuous dynamic Joule heating treatment.

2. Brief Description of the Prior Art

Ferromagnetic amorphous alloys have been widely used in many applications such as distribution transformers, magnetic shielding, security tape, etc. For the above applications, ferromagnetic amorphous alloys are usually made in the form of a long ribbon with desired width and thickness. The ribbons of such alloys must be heat treated before their magnetic applications. Iron base amorphous alloys are suitable for commercial mass production and applications because of their high saturation magnetization and relatively low cost. However an undesired annealing embrittlement occurs in the process of a conventional furnace annealing. This will effect the applications of the ferromagnetic amorphous alloys.

In U.S. Pat. No. 4,288,260 issued in September 1981, Senno et al proposed a dynamic annealing method of passing the amorphous ribbon over a hot body. Another heating process to pass an amorphous ribbon over a hot block heated by a quartz line heater was disclosed in U.S. Pat. No. 4,482,402 by Taub. None of these prior art methods could provide dynamic Joule heating to improve the magnetic properties of the ferromagnetic amorphous alloys.

SUMMARY OF THE INVENTION

It is therefore a main object of the present invention to provide a process for heat-treating the ferromagnetic amorphous alloys to improve their magnetic properties such as high magnetic induction (Bm), low coercivity (Hc) and low core loss.

Another object of the present invention is to provide an apparatus to carry out the treatment procedures of the method of the invention.

The most important feature of the method of heat-treating the ferromagnetic amorphous alloys is the step of dynamic Joule heating by applying pulsed high current or AC current to the long ferromagnetic amorphous ribbons.

It is believed that the soft magnetic properties of the ferromagnetic amorphous alloys are improved by the effects fast stress-relief and fast impulse of magnetic domain wall motion.

Another object and advantage of the present invention is to provide a process of heat-treating the ferromagnetic amorphous alloys to avoid possible annealing embrittlement. It is believed that the fast heating and cooling rate causes the alloys to avoid timedependent structural relaxation.

Another object of the present invention is to use the Joule Effect ($P=I^2R$) to heat the moving amorphous ribbon of ferromagnetic amorphous alloys by applying pulsed high current or AC current therethrough.

Accordingly, the method of continuous dynamic Joule heating comprises the steps of providing a pair of electrodes that are connected to an AC power supply or pulse generator, continuously passing a long ribbon of ferromagnetic amorphous alloy over the electrodes, applying a magnetic field on said long ribbon along the length direction thereof and collecting the treated ribbon.

The apparatus of continuous dynamic Joule Heating treatment comprises a pair of electrodes connected to an AC power supply or pulse generator, means for conveying a long ribbon of ferromagnetic amorphous alloy continuously passing through said pair of electrodes, means for generating a magnetic field along the length direction of said long ribbon and a collecting means to collect the treated long ribbon.

BRIEF DESCRIPTION OF THE DRAWINGS

Those and other advantages, objects and features of the present invention will become apparent from the following detailed description of the preferred embodiments with reference to the accompanying drawings.

DETAILED DESCRIPTION OF THE PREFERRED EMBODIMENTS

The method of continuous dynamic Joule heating treatment will be described in accompanying with the descriptions of the apparatus for performing the treatment. Each step or procedure of the method will be apparent from the description of the apparatus and the operation thereof.

Figure 1:
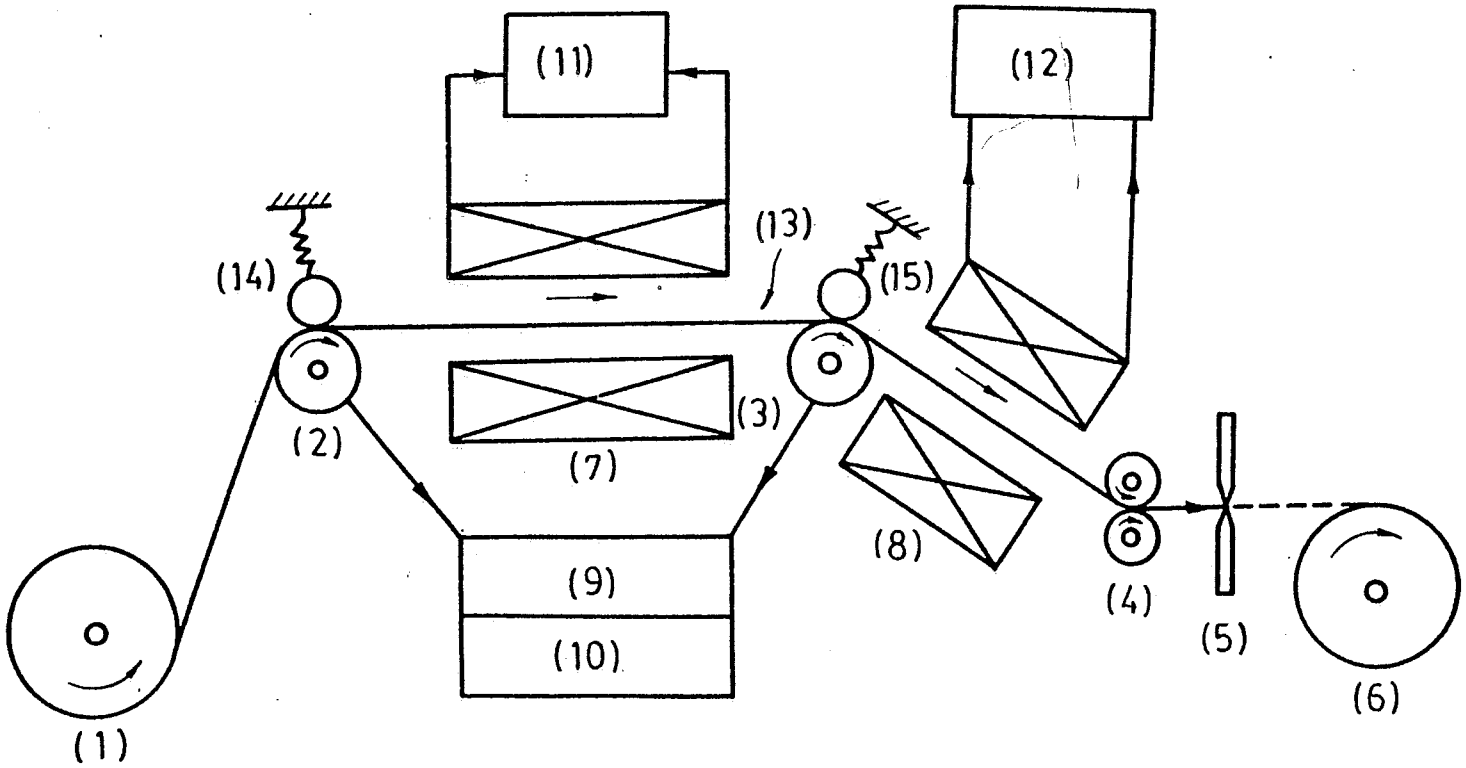
FIG. 1 is a simplified schematic diagram of the apparatus for heat-treating the straight long ribbon of ferromagnetic amorphous alloy.

Referring to FIG. 1 which is the apparatus or system for heat-treating a long straight ribbon of ferromagnetic amorphous alloy, a long as-cast amorphous ribbon is wound on a supply reel 1 and guided to pass a pair of rollers 2, 3 made by 304 or 316 stainless steel and another pair of spring biased rollers 14 and 15. Rollers 2 and 3 are connected to a high current pulse generator 9 or an AC power supply so as to act as electrodes for conducting currents through ribbon section therebetween. The spring biased rollers 14 and 15 are arranged for the purpose of better electric contact. The long ribbon moves slowly to pass the rollers 2 and 3 and in the meanwhile heated by the current conducted thereon. The heat-treated long ribbon can then be collected onto a pick-up reel 6 or fed into a cutting machine 5 to be cut into a dimension required such as short stripes for a certain applications. In order to get an induced magnetic anisotropy along the length direction of the ferromagnetic amorphous ribbon, two solenoids 7 and 8 are provided to produce DC magnetic fields $H_1$ and $H_2$ when the ribbon is under dynamic Joule heating and after dynamic Joule heating. Each solenoid 7, 8 is connected with their terminals to the output of a DC power supply 11, 12. The applied DC magnetic fields $H_1$ and $H_2$ are to improve the soft magnetic properties of the ferromagnetic amorphous alloys. With different applied magnetic field H on the ribbon, different magnetic induction (Bm), coercivity (Hc) and hysteresis loss (Pc) values will be obtained. This will be more detailed discussed with the examples stated hereinbelow.

Figure 2:
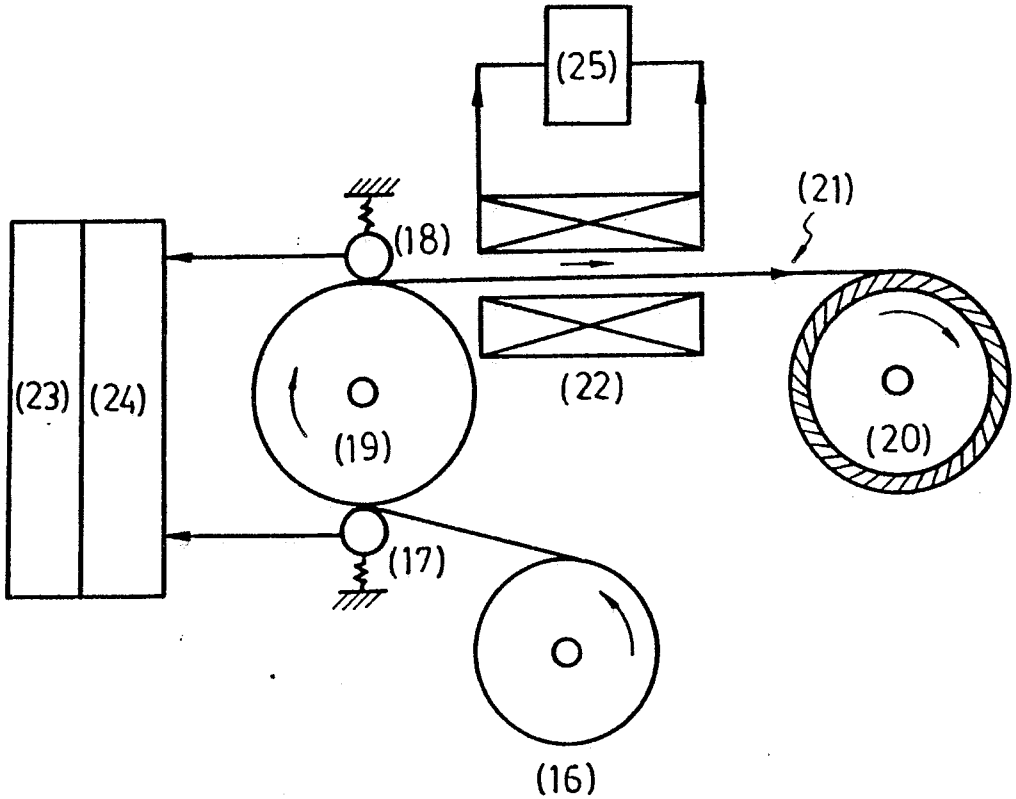
FIG. 2 is a simplified schematic diagram of the apparatus for heat-treating the curved long ribbon of ferromagnetic amorphous alloy.

Referring to FIG. 2 which is the apparatus or system of performing the continuous dynamic Joule heating treatment for a curved ribbon of ferromagnetic amorphous alloy, the long as-cast amorphous ribbon is wound on a supply reel 16 and guided to pass over an insulated roller 19 preferably made of ceramics. A pair of spring biased rollers 17 and 18 are provided at the lateral sides of said insulated roller 19 and to supply current to the ribbon passed from a pulse generator 23 or an AC power supply 24. The dynamic Joule heating is carried out on the ribbon section between the two electrodes 17 and 18. After treatment, the long ferromagnetic amorphous ribbon is collected onto a pick-up reel 20 or wound up directly as a toroidal transformer core. It is appreciated that the average radius of the toroidal transformer core is almost the same as the radius of the curve for dynamic Joule heating. Again, in order to get an induced magnetic anisotropy along the length direction of the ferromagnetic amorphous ribbon, a solenoid 22 is provided to produce a DC magnetic field $H_3$ on the ribbon portions already treated. The solenoid 22 is connected to a DC power supply 25.

The examples of continuous Joule heating are described and discussed hereinbelow.

1. Conditions of the apparatus used for performing the continuous dynamic Joule heating treatment.

A. Speed of moving amorphous ribbon $0<v\leqq 10$cm/sec

B. Applied magnetic field (H, H, H)$\geqq$20 Oe

C. Heating time $t_k=1$ sec$\sim$200 sec

D. Pulsed high current heating a. pulsed current density $J\geqq 10^3$A/cm$^2$ b. pulse duration $t_p=1$ ns$\sim$100 ms c. frequency f=1 Hz$\sim$1,000 Hz E. AC current heating a. wave type-sine wave, triangular wave and square wave b. frequency f=50 Hz$\sim$50 KHz c. current density $J\leqq 10^2$ A/cm$^2$ 2. Examples.

EXAMPLE 1

Dynamic Joule heating by pulsed high current for ferromagnetic amorphous alloy $Fe_{78}B_{13}Si_9$(Allied 2605S2)

| | | |
|---|---|---|
| Specimen: | a. length | L = 100 cm |
| | b. width | w = 0.3 cm |
| | c. thickness | t = 25 μm |
| | d. weight | W = 0.465 g |

Range of dynamic Joule heating: l=15cm

Speed of moving specimen: v=0.3cm/sec

Resistance in dynamic Joule heating: R≃3.0Ω

Conditions of pulse heating:

a. pulse current density $J=5.42\times 10^4$ A/cm$^2$ b. pulse duration $t_p=271\mu s$ c. frequency f=9.4 Hz Heating time $t_h=50$ sec

| | |
|---|---|
| Applied magnetic field | $H_1$ = 200 Oe<br>$H_2$ = 200 Oe |

Figure 3:
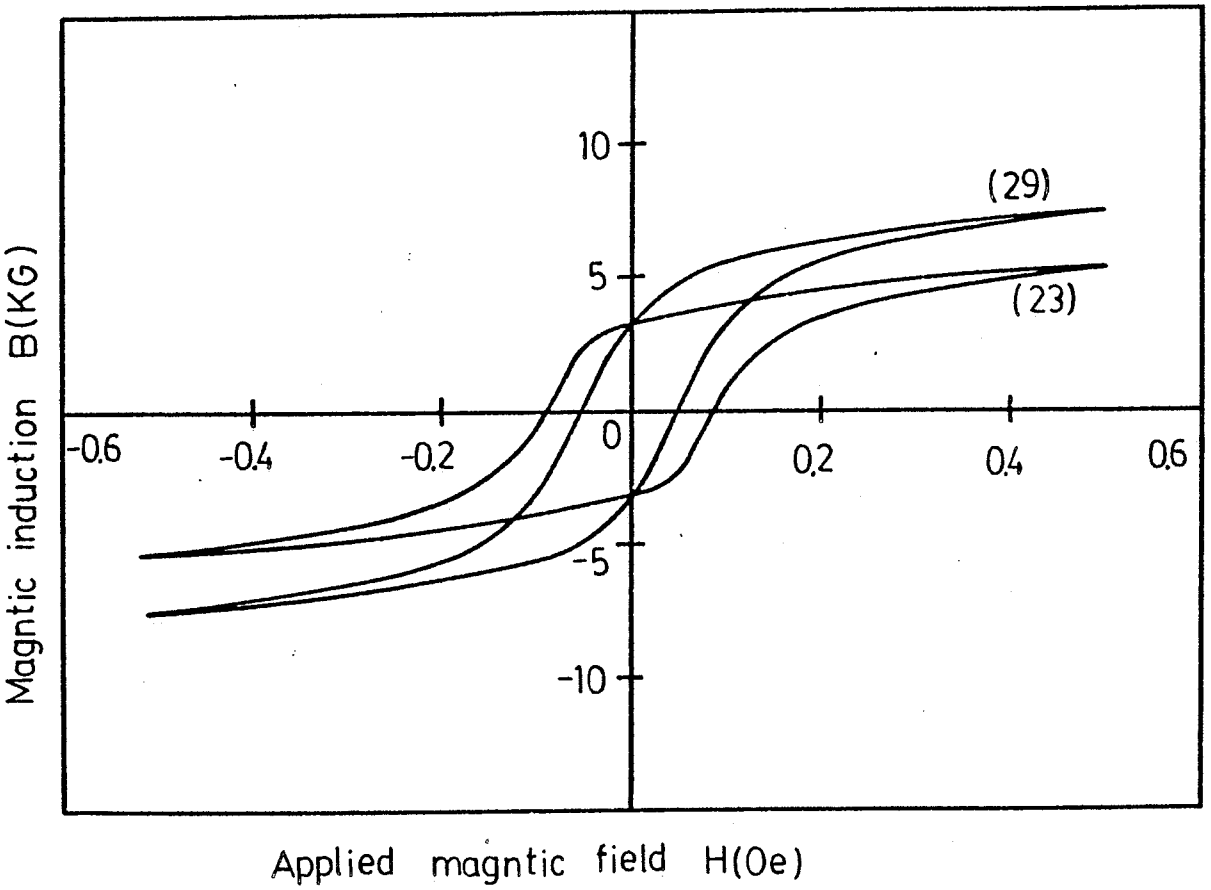
FIGS. 3, 4 and 5 are charts showing the B-H hysteresis loops of amorphous alloy $Fe_{78}B_{13}Si_9$ as-cast and after treatment by the method of the present invention at different applied magnetic fields.
Figure 4:
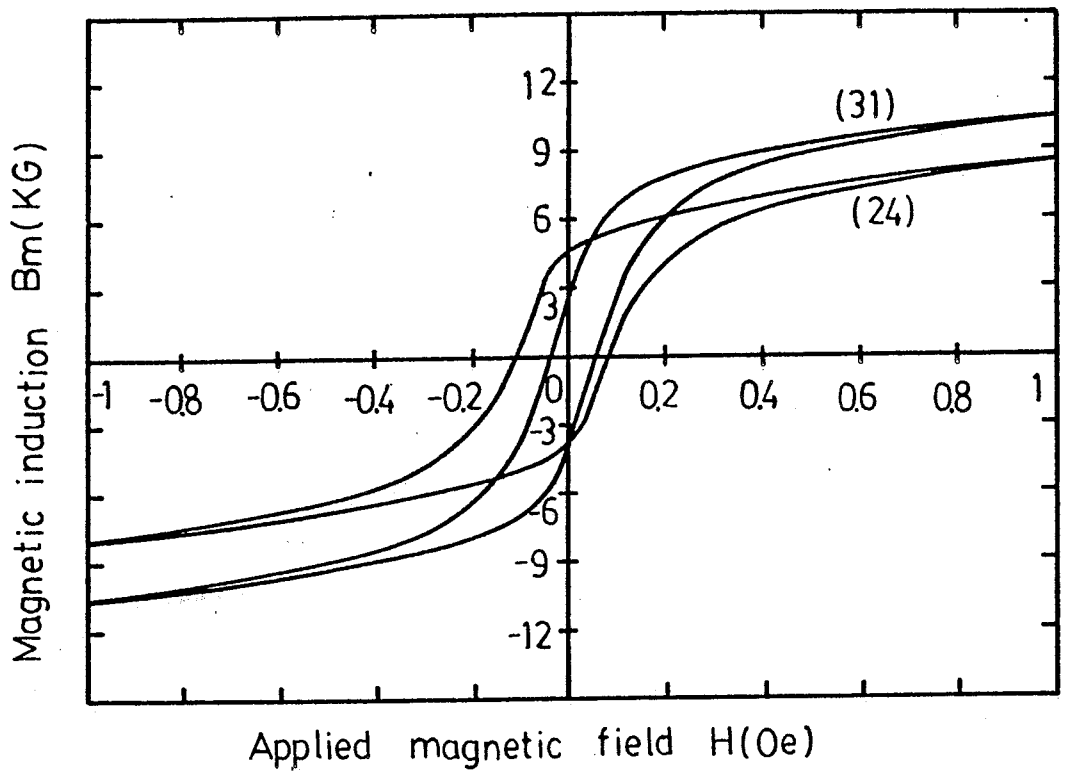
Figure 5:
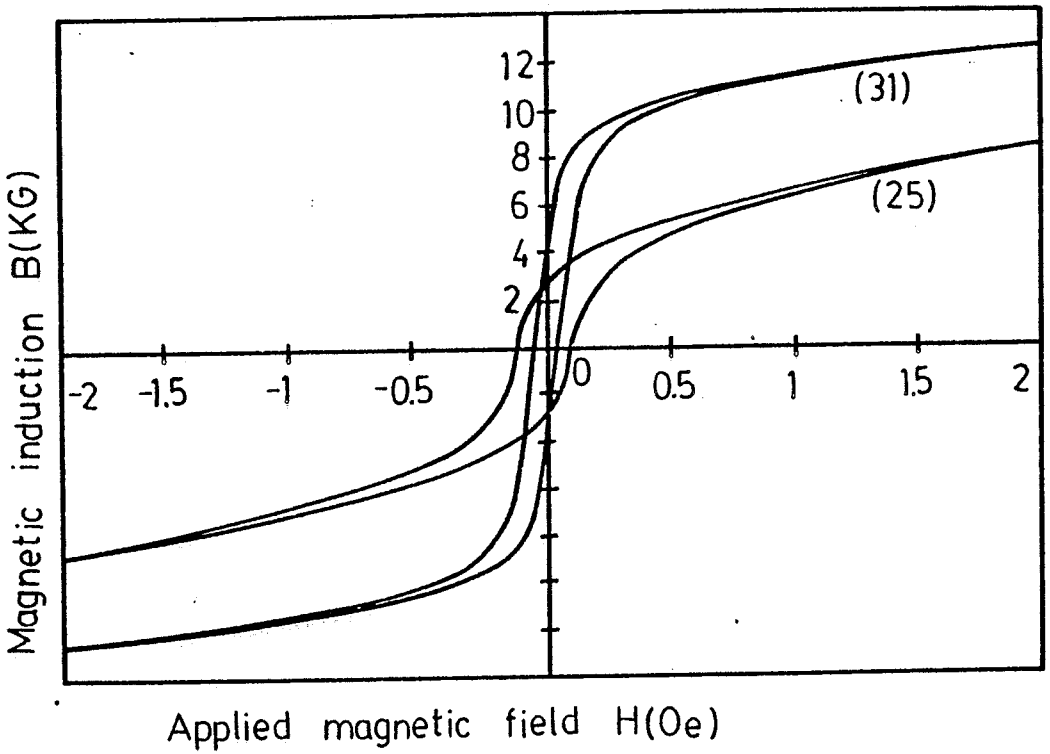

Comparing the hysteresis loops (26), (27) and (28) of as-cast specimen and those (29), (30) and (31) of specimen after dynamic Joule heating which were measured under the applied magnetic field of ranges are −0.5 Oe to 0.5 Oe, −1 Oe to 1 Oe and −2 Oe to 2 Oe as shown in FIG. 3, FIG. 4 and FIG. 5, the soft magnetic properties are significantly improved as follows:

| | as-cast | after heating |
|---|---|---|
| (1) magnetic coercivity Hc(Oe) | | |
| (when applied field Hm = ±1 Oe) | 0.055 | 0.025 |
| (2) magnetic induction Bm(KG) | | |
| (when Hm = ±0.5 Oe) | 4.81 | 7.09 |
| (when Hm = ±1 Oe) | 6.48 | 10.65 |
| (when Hm = ±2 Oe) | 8.58 | 12.66 |

Figure 6:
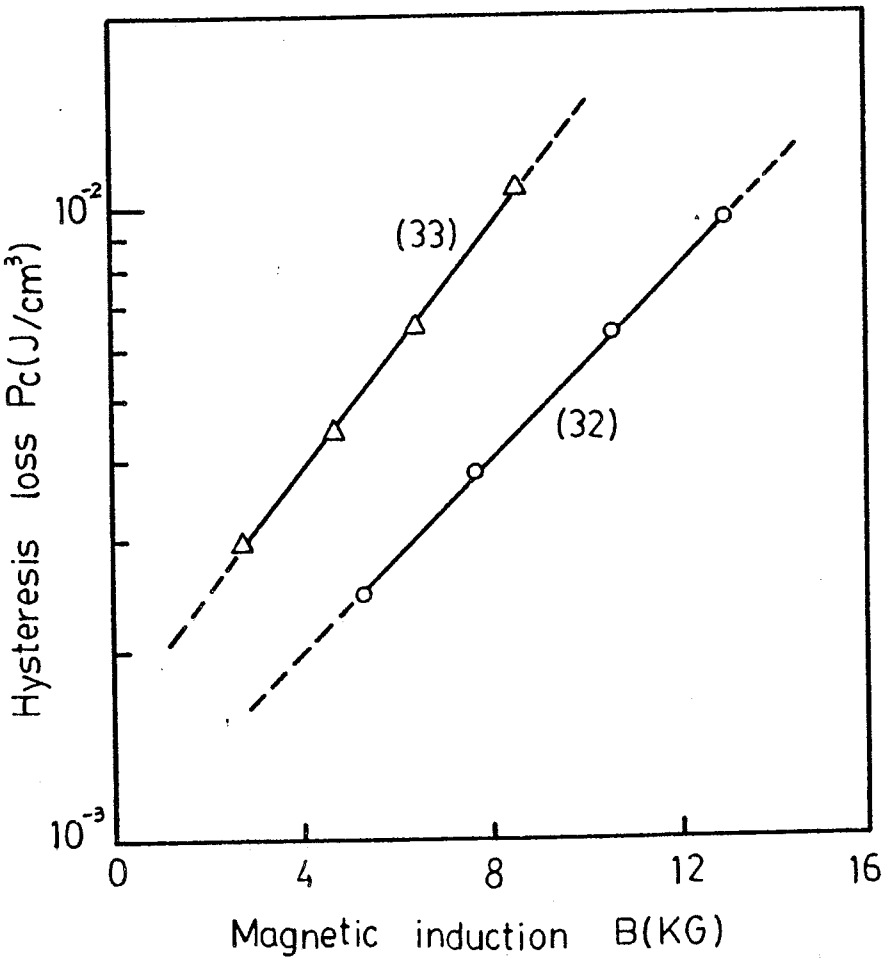
FIG. 6 is a chart showing hysteresis loss of amorphous alloy $Fe_{78}B_{13}Si_9$ as-cast and after treatment by the method of the present invention.

(3) Hysteresis loss of curve (32) for specimen after heating is much lower than the curve (33) for as-cast specimen as shown in FIG. 6.

The annealing embrittlement of specimens can be compared by bending test. The fracture strain $\epsilon_f$ of specimen by dynamic Joule heating is much better than that of specimens by conventional furnace annealing as follows:

| | furnace annealing | dynamic Joule heating |
|---|---|---|
| fracture strain $\epsilon_f$ | 7 × 10 ~ 5 × 10 | 0.9 ~ 1 |

EXAMPLE 2

Dynamic Joule heating by AC current for ferromagnetic amorphous alloy $Fe_{40}Ni_{38}Mo_4B_{18}$ (Allied 2826MB)

| | | |
|---|---|---|
| Specimen: | length | L = 100 cm |
| | width | w = 0.3 cm |
| | thickness | t = 32 μm |
| | weight | W = 0.584 g |

Speed of moving specimen v=0.2cm/sec

Range of dynamic Joule heating l=15cm

Resistance in dynamic Joule heating R≃2.5Ω

Conditions of AC current:

a. frequency f=60 Hz b. wave type--sine wave c. current density $J=2.75\times 10^3$ A/cm$^2$

| | |
|---|---|
| Applied magnetic field | $H_1$ = 200 Oe<br>$H_2$ = 200 Oe |

Figure 7:
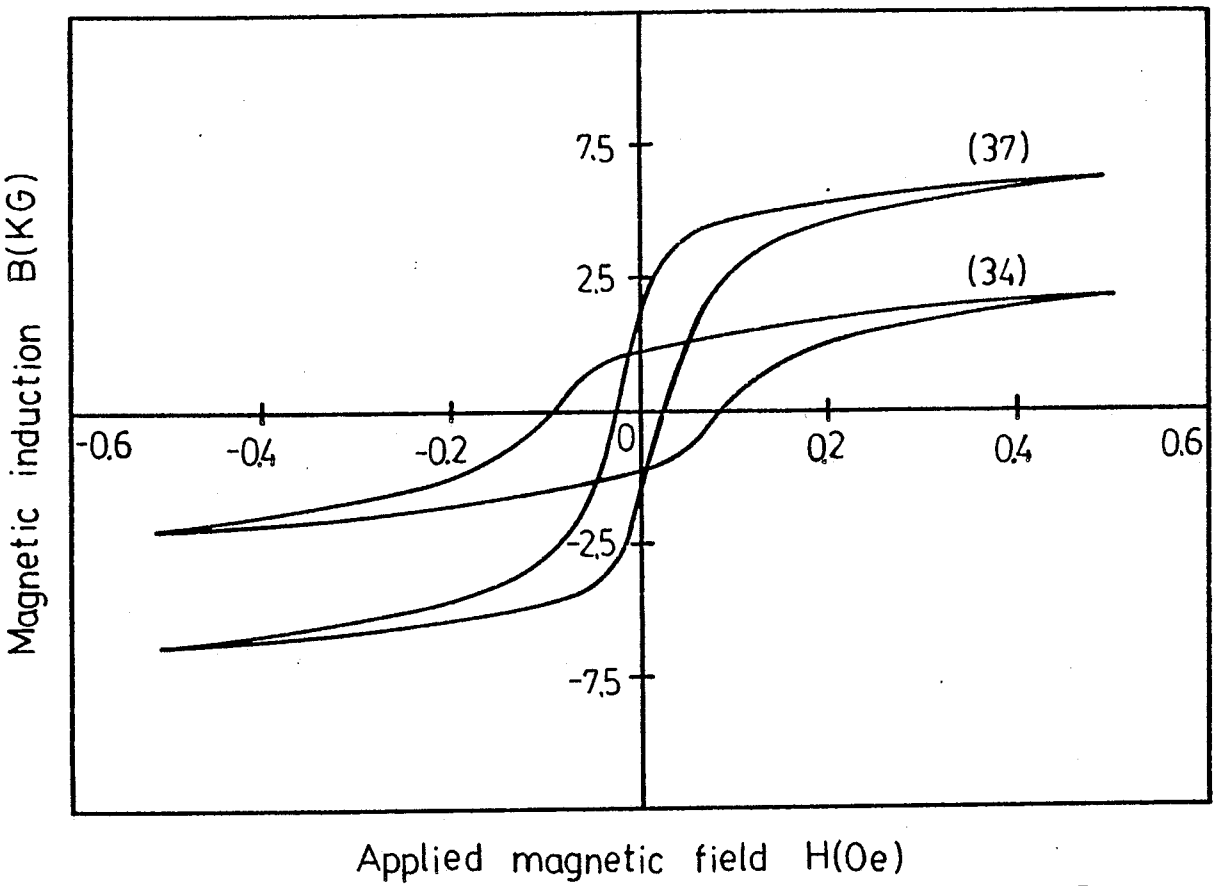
FIG. 7, 8 and 9 are charts showing the B-H hysteresis loops of amorphous alloy $Fe_{40}Ni_{38}Mo_4B_{18}$ as-cast and after treatment by the method of the present invention at different applied magnetic fields.
Figure 8:
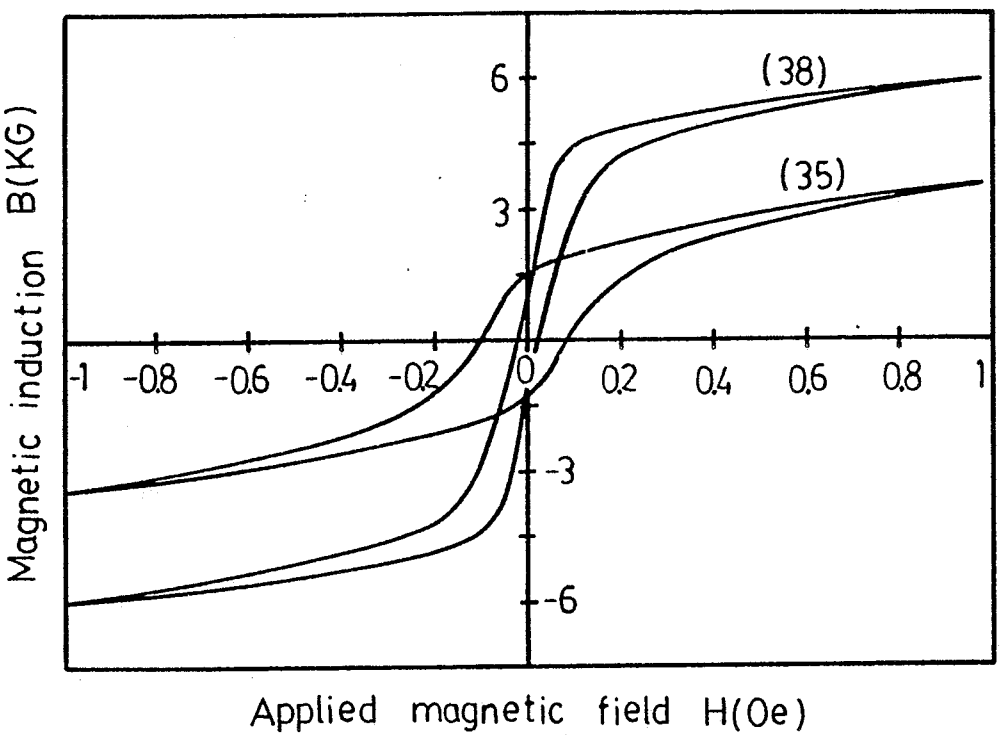
Figure 9:
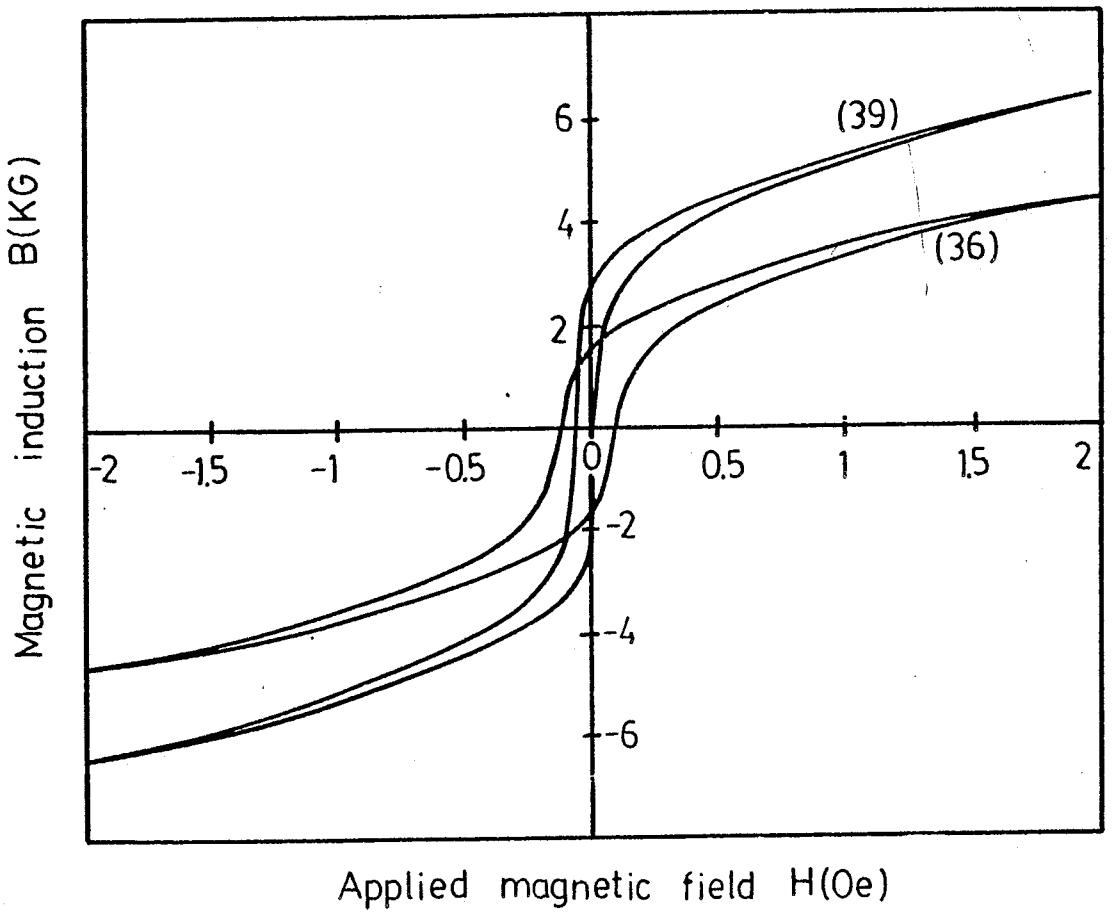

Comparing the hysteresis loops (34), (35) and (36) of as-cast specimen with those (37), (38) and (39) of specimen after heating which were measured with applied magnetic field of ranges −0.5 Oe to 0.5 Oe, −1 Oe to 1 Oe and −2 Oe to 2 Oe as shown in FIG. 7, FIG. 8 and FIG. 9, the soft magnetic properties significantly improved as follows:

| | as-cast | after heating |
|---|---|---|
| (1) magnetic coercivity Hc(Oe) | | |
| (when applied field Hm = ±1 Oe) | 0.048 | 0.013 |
| (2) magnetic induction Bm(KG) | | |
| (when Hm = ±0.5 Oe) | 2.45 | 4.89 |
| (when Hm = ±1 Oe) | 3.22 | 5.59 |
| (when Hm = ±2 Oe) | 4.33 | 6.39 |

Figure 10:
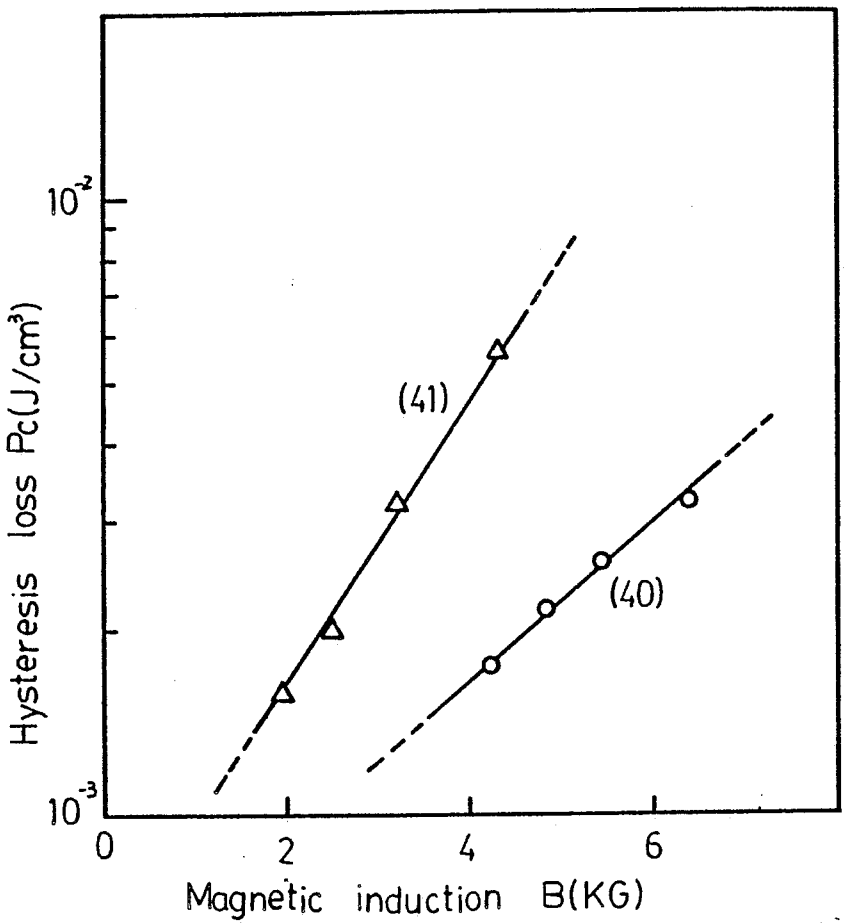
FIG. 10 is a chart showing hysteresis loss of amorphous ribbon $Fe_{40}Ni_{38}Mo_4B_{18}$ as-cast and after treatment by the method of the present invention.

(3) Hysteresis loss of curve (40) for specimen after heating is much lower than the curve (41) for as-cast specimen as shown in FIG. 10.

The annealing embrittlement of specimens can be compared by bending test. The fracture strain $\epsilon_f$ of specimen by dynamic Joule heating is much better than that of specimens by conventional furnace annealing as follows:

| | furnace annealing | dynamic Joule heating |
|---|---|---|
| fracture strain $\epsilon_f$ | 9 × 10 ~ 5 × 10 | 0.9 ~ 1 |

The method and apparatus of continuous dynamic Joule heating to improve the magnetic properties and to avoid annealing embrittlement of ferromagnetic amorphous alloys have been described hereinabove by way of preferred embodiments. It is noted that modifications and changes are still possible for those skilled in the art without departing from the spirit of the invention.

What is claimed is:

1. An apparatus for continuous dynamic Joule heating of ferromagnetic amorphous ribbons, comprising:

means for supplying an AC current or pulsed high current;

a pair of electrode rollers connected to said AC current or pulsed high current supply means;

guiding means in cooperation with said pair of electrode rollers for conveying the amorphous ribbon to move over said electrode rollers and to be heat-treated between said electrode roller; and means for applying a magnetic field along a length direction of said amorphous ribbon at a section of said amorphous ribbon extending beyond said pair of electrode rollers.

2. The apparatus as claimed in claim 1, further comprises means for collecting said amorphous ribbon that has been heat-treated.

3. The apparatus as claimed in claim 1, wherein the AC current has a frequency f=50 Hz to 50 KHz and a current density J greater or equal to $10^2/cm^2$.

4. The apparatus as claimed in claim 1, wherein the pulsed high current has a pulse current density J greater or equal to $10^3 A/cm^2$, a pulse duration $t_p$=1ns to 100ms, and a frequency f=1Hz to 1,000 Hz.

5. The apparatus as claimed in claim 1, wherein the guiding means for conveying the amorphous ribbon moves with a speed v=0 to 10cm/sec and controls the heating time $t_h$=1 second to 200 seconds between said electrodes.

6. The apparatus as claimed in claim 1, further comprising means for applying another magnetic field along a length direction of said amorphous ribbon at a section of said ribbon between said pair of electrodes.

7. The apparatus as claimed in claim 1, wherein said guiding means includes an insulated roller member positioned between and adjacent said pair of electrode rollers to provide a curved path for the amorphous ribbon.

* * * * *